US009201352B2

(12) United States Patent
Takazawa

(10) Patent No.: US 9,201,352 B2
(45) Date of Patent: Dec. 1, 2015

(54) TRANSFER BELT, TRANSFER BELT UNIT, AND IMAGE FORMATION APPARATUS

(71) Applicant: Oki Data Corporation, Tokyo (JP)

(72) Inventor: Takayuki Takazawa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/667,835

(22) Filed: Mar. 25, 2015

(65) Prior Publication Data

US 2015/0277301 A1 Oct. 1, 2015

(30) Foreign Application Priority Data

Mar. 26, 2014 (JP) ..... 2014-064324

(51) Int. Cl.
*G03G 15/20* (2006.01)
*G03G 15/16* (2006.01)
*G03G 15/01* (2006.01)

(52) U.S. Cl.
CPC ..... *G03G 15/1615* (2013.01); *G03G 15/0131* (2013.01); *G03G 15/1605* (2013.01); *G03G 15/1685* (2013.01)

(58) Field of Classification Search
CPC ..... G03G 15/1615; G03G 15/1685; G03G 15/1605; G03G 15/0131
USPC ..... 399/302, 303, 308, 312, 313
See application file for complete search history.

(56) References Cited

U.S. PATENT DOCUMENTS 8,050,604 B2 * 11/2011 Tominaga ..... 399/302

FOREIGN PATENT DOCUMENTS

JP 2007-225969 A 9/2007

* cited by examiner

*Primary Examiner* — Hoang Ngo
(74) *Attorney, Agent, or Firm* — Marvin A. Motsenbocker; Mots Law, PLLC

(57) ABSTRACT

A transfer belt used in an image formation apparatus is provided with surface characteristics that Vickers hardness of an outer peripheral surface of the transfer belt is within a range between being equal to or above 39 N/mm$^2$ and equal to or below 60 N/mm$^2$, and a low-load creep of the outer peripheral surface is within a range between being equal to or above −45% and equal or to below 0%.

8 Claims, 6 Drawing Sheets

Fig.6

| | VICKERS HARDNESS HV [N/mm$^2$] | LOW-LOAD CREEP C_IT_L [%] | ABRASION AFTER 200 ROUNDS [μm] | CHANGE IN SPECULARITY | CLEANING PERFORMANCE (SLIP THROUGH) |
|---|---|---|---|---|---|
| EXAMPLE 1 | 55 | −8 | 0.20 | −8 | 1 |
| EXAMPLE 2 | 48 | −22 | 0.32 | −12 | 1 |
| EXAMPLE 3 | 45 | −43 | 0.33 | −15 | 2 |
| EXAMPLE 4 | 45 | −23 | 0.32 | −14 | 2 |
| EXAMPLE 5 | 39 | −45 | 0.37 | −16 | 2 |
| EXAMPLE 6 | 39 | −14 | 0.35 | −18 | 2 |
| EXAMPLE 7 | 53 | −44 | 0.35 | −19 | 2 |
| EXAMPLE 8 | 41 | −24 | 0.38 | −17 | 2 |
| EXAMPLE 9 | 42 | −53 | 0.41 | −24 | 3 |
| EXAMPLE 10 | 35 | −34 | 0.43 | −23 | 3 |
| EXAMPLE 11 | 35 | −47 | 0.47 | −27 | 3 |
| EXAMPLE 12 | 37 | −58 | 0.52 | −26 | 4 |
| EXAMPLE 13 | 53 | −59 | 0.53 | −24 | 4 |
| EXAMPLE 14 | 44 | −59 | 0.50 | −28 | 4 |
| EXAMPLE 15 | 40 | −60 | 0.49 | −22 | 4 |

TRANSFER BELT, TRANSFER BELT UNIT, AND IMAGE FORMATION APPARATUS

CROSS REFERENCE TO RELATED APPLICATIONS

This application claims priority based on 35 USC 119 from prior Japanese Patent Application No. 2014-064324 filed on Mar. 26, 2014, entitled "TRANSFER BELT, TRANSFER BELT UNIT, AND IMAGE FORMATION APPARATUS", the entire contents of which are incorporated herein by reference.

BACKGROUND OF THE INVENTION

1. Field of the Invention

This disclosure relates to a transfer belt, a transfer belt unit, and an image formation apparatus, which are applicable, for example, to a transfer belt configured to transfer a developer image (hereinafter also referred to as a toner image) onto a record medium or the like, a transfer belt unit including the transfer belt, and an image formation apparatus including the transfer belt unit.

2. Description of Related Art

A conventional image formation apparatus is designed to transfer a toner image on a surface of a photoconductor drum to a record medium or the like. The image formation apparatus is therefore provided with a transfer belt in order to transfer the record medium toward the photoconductor drum and a transfer roller(s).

Such a conventional transfer belt is set to have a predetermined surface roughness and specularity in order to enable conveyance of record media. In the meantime, for the purpose of cleaning substances attached onto the transfer belt such as residual toner, for example, a cleaning blade made of urethane rubber, for instance, scrapes off the attached substances by being in contact with the transfer belt (see Japanese Patent Application Publication No. 2007-225969, for example).

SUMMARY OF THE INVENTION

However, according to the above-described related art, the transfer belt includes a main layer (a surface layer) formed of a soft resin. For this reason, the specularity of the surface of the transfer belt in contact with the cleaning blade is reduced due to surface friction with the passage of printing time, whereby a cleaning performance of the cleaning blade is deteriorated. As a consequence, it is difficult to maintain a reliable cleaning performance for a long period of time.

An object of an embodiment of the invention is to suppress surface friction and surface deformation of a transfer belt.

An aspect of the invention is a transfer belt used in an image formation apparatus. The transfer belt is provided with surface characteristics that Vickers hardness of an outer peripheral surface of the transfer belt is equal to or above 39 $N/mm^2$ and equal to or below 60 $N/mm^2$, and low-load creep of the outer peripheral surface is equal to or above −45% and equal or to below 0%.

According to this aspect of the invention, it is possible to suppress the surface friction and surface deformation of a transfer belt.

BRIEF DESCRIPTION OF THE DRAWINGS

FIG. 6 is a table listing the results of abrasion resistance tests, results of cleaning performances, and results of changes in the specularity of the transfer belts of the embodiment having different surface hardness characteristics.

DETAILED DESCRIPTION OF EMBODIMENTS

Figure 1:
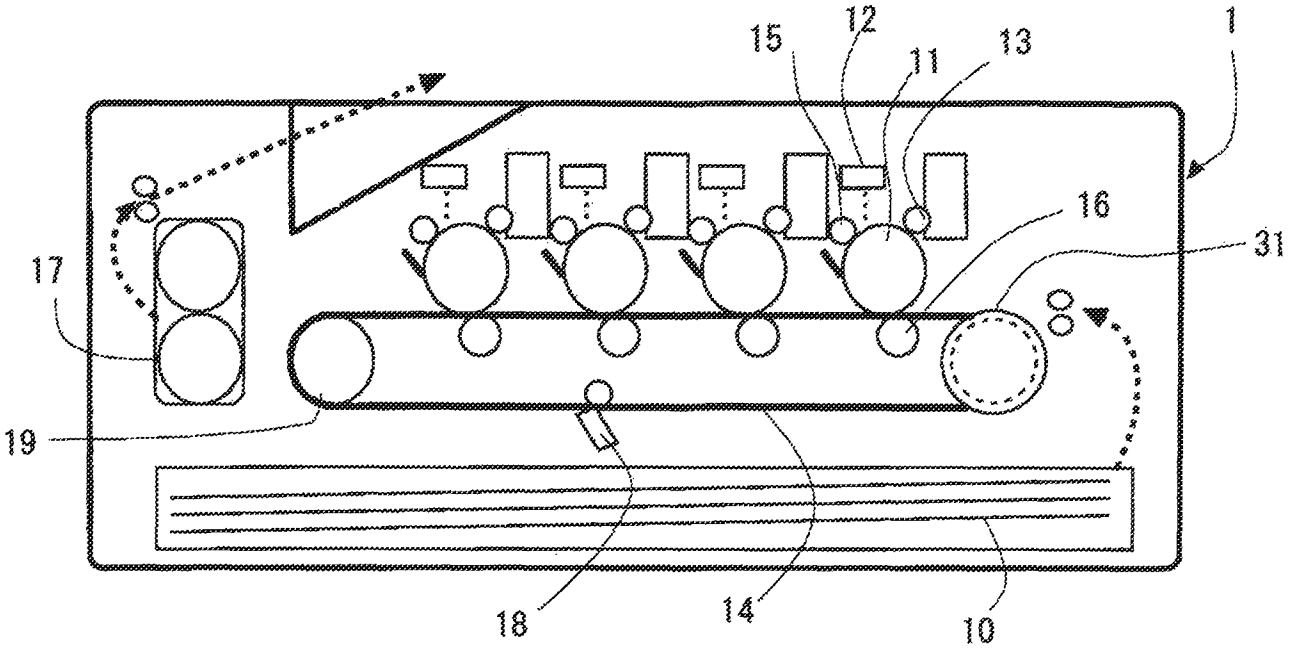
FIG. 1 is a configuration diagram illustrating a configuration of an image formation apparatus according to an embodiment.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

(A) Main Embodiment

In the following, a transfer belt, a transfer belt unit, and an image formation apparatus according to an embodiment of the invention are described below in detail with reference to the drawings.

This embodiment describes the case of applying the invention to an electrophotographic color printer as an example.

(A-1) Configuration of Embodiment

(A-1-1) Image Formation Apparatus

FIG. 1 is a configuration diagram illustrating a configuration of an image formation apparatus of the embodiment.

In FIG. 1, image formation apparatus 1 of the embodiment includes photoconductor drums 11 each serving as an image carrier, charge rollers 15 each serving as a charging device, LED heads 12 each serving as an exposure device, development units 13 each serving as a development device, transfer rollers 16 each serving as a transfer device, transfer belt 14, fixation unit 17 as a fixation device, cleaning blade 18 as a cleaning unit, and sheet feeder unit 10.

Image formation apparatus 1 includes four image formation units provided for forming images by respectively using toner in four colors of Y (yellow), M (magenta), C (cyan), and B (black), for example. Here, the printing method adopted by image formation apparatus 1 is not limited to a particular method, and a wide variety of methods including a tandem method, a four-cycle method, and the like are applicable thereto.

Each image formation unit includes photoconductor drum 11, charge roller 15, LED unit 12, development unit 13, and transfer roller 16. The four image formation units each contain a toner in a different color from the other image formation units. However, the configurations and functions of these image formation units are the same as or equivalent to one another.

In order to simplify the explanation, photoconductor drum 11, charge roller 15, LED unit 12, development unit 13, and transfer roller 16 constituting the Y (yellow) image formation unit are described below as a representative example.

Sheet feeder unit 10 is designed to contain record materials as record media.

A surface of photoconductor drum 11 is uniformly charged by charge roller 15 and is then subjected to exposure with LED head 12, thereby forming an electrostatic latent image thereon. Moreover, the toner serving as a developer is supplied by developer roller 15 to the surface of photoconductor drum 11 to form a developer image thereon.

Charge roller 15 is configured to charge the surface of photoconductor drum 11. While this embodiment depicts an example in which the charge device adopts a roller method, the charge device can also apply various noncontact methods (such as a corotron charging method, a scorotron charging method, and a solid-state discharging element method).

LED head 12 is configured to perform an exposure of the surface of photoconductor drum 11 on the basis of print data. While this embodiment depicts an example in which the exposure device is LED head 12, the exposure device is not limited only to LED head 12, and the exposure device may instead apply a laser method, for example.

Development unit 13 is configured to supply the developer onto the surface of photoconductor drum 11 provided with the electrostatic latent image, and thereby developing the image. Various methods can be adopted as the development method by development device 13. For example, a one-component contact development method, a two-component contact development method, a one-component non-contact development method, a two-component non-contact development method, and the like are applicable.

Transfer roller 16 is located at a position opposed to photoconductor drum 11 while interposing transfer belt 14 in between, and is configured to transfer the developer image on the surface of photoconductor drum 11 to a record material.

Fixation unit 17 is configured to fix the developer image, which is transferred onto the record material, to the record material. Fixation unit 17 includes a heat roller and a pressure roller so as to achieve the fixation by use of heat and pressure.

Transfer belt 14 is configured to convey the record material fed from the sheet feeder unit 10 toward photoconductor drum 11.

Cleaning blade 18 is in contact with the surface of transfer belt 14, and is configured to remove attached substances, such as the toner and foreign materials remaining on the surface of transfer belt 14.

In FIG. 1, sheet feeder unit 10 feeds the record material when image formation apparatus 1 acquires a print instruction from a host apparatus, for example. Transfer belt 14 conveys the fed record material to photoconductor drum 11. Meanwhile, charge roller 15 charges the surface of photoconductor drum 11, and LED head 12 forms the electrostatic latent image on the surface of photoconductor drum 11 on the basis of the print data. Development unit 13 supplies the developer onto the surface of photoconductor drum 11 where the electrostatic image is formed, and develops the image. Hence, the electrostatic latent image turns into a visible image. The visible image on the surface of photoconductor drum 11 is sequentially transferred by transfer roller 16 onto the record material which is conveyed by transfer belt 14 that supports the record material. The record material carrying the transferred toner image is sent to fixation unit 17 where the toner image is fixed to the record material. The record material is then discharged. After the record material is separated from the transfer belt, transfer belt 14 is cleaned by cleaning blade 18 configured to remove the toner and the foreign materials remaining on belt 14.

(A-1-2) Transfer Belt Unit

Figure 2:
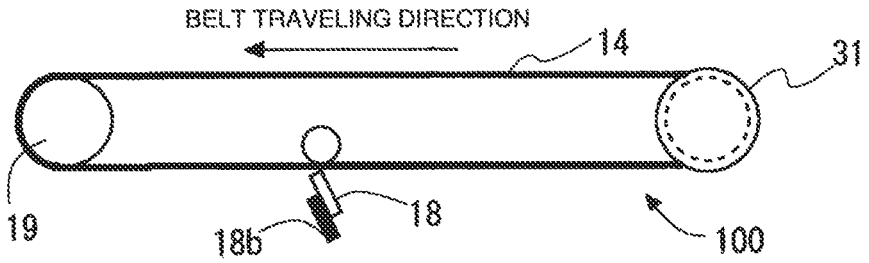
FIG. 2 is a schematic diagram illustrating a configuration of a transfer belt unit according to the embodiment.

FIG. 2 is a schematic diagram illustrating a configuration of a transfer belt unit according to the embodiment.

In FIG. 2, transfer belt unit 100 includes transfer belt 14, drive rollers 19 as a belt drive unit, flange 31 as a guide member, and cleaning blade 18.

Transfer belt 14 is an endless belt. Transfer belt 14 is stretched by a not-illustrated stretching unit with a tensile force of about 4 kg±10%. Transfer belt 14 is rotated by drive rollers 19.

Flange 31 is in contact with a corner portion of transfer belt 14. Flange 31 is driven and rotated by the rotation of transfer belt 14, and is provided in order to prevent transfer belt 14 from meandering. Here, flange 31 may also be added to other rotation units as appropriate, or may be added to each of the two corner portions of transfer belt 14.

In this embodiment, a blade cleaning method as illustrated in FIG. 2 is adopted as a method of cleaning transfer belt 14.

Cleaning blade 18 is supported by support unit 18*b*. Cleaning blade 18 is brought into contact with the surface of transfer belt 14 so as to remove the toner remaining on the surface of transfer belt 14.

Cleaning blade 18 is preferably made of an elastic material having a rubber hardness in the range of JIS A 60° to 90°. This embodiment applies urethane rubber having a hardness of JIS A 72° and a plate thickness of 1.5 mm. Because the blade is made of an elastic material such as urethane rubber which has an excellent function to remove the attached substances such as the toner and foreign materials remaining on the surface of transfer belt 14. Moreover, the configuration of the blade is simple, compact, and low in cost. In addition, the urethane rubber is suitable for the rubber material of cleaning blade 18 because the urethane rubber has a high hardness as well as high elasticity, and its abrasion resistance, mechanical strength, oil resistance, ozone resistance, and the like are excellent.

Meanwhile, a linear pressure of cleaning blade 18 is set in a range of from 1 g/mm to 6 g/mm, or preferably in a range of from 2 g/mm to 5 g/mm. In this embodiment, the linear pressure is set to 4.3 g/mm as illustrated in FIG. 2. This is because, if the linear pressure is too small, adhesion to transfer belt 14 is insufficient and a cleaning defect is likely to occur. On the other hand, if the linear pressure is too large, cleaning blade 18 becomes into plane contact with transfer belt 14 and friction resistance becomes excessive. In this case, a failure, such as turn-up of cleaning blade 18, is apt to occur as its contact pressure surpasses its scraping force.

A shaft diameter of each drive roller 19 is set to ø25 [mm] in this embodiment. However, the shaft diameter is not limited to this value. Drive rollers 19 having diameters in a range from ø10 to ø50 [mm] are generally used in light of cost and size reduction of the device, for example.

Springs are used as the stretching unit for transfer belt 14 in this embodiment. Specifically, transfer belt 14 is stretched by a force of 4 kg±10% (2 kg×2). However, the method of stretching transfer belt 14 is not limited only to the foregoing. Meanwhile, the force to stretch transfer belt 14 is also selected as appropriate depending on the material used for transfer belt 14 and on a driver unit of transfer belt 14. Generally, transfer belt 14 is often stretched by a force in a range from 2 to 8 kg±10%.

The toner used in this embodiment contains a pulverized binder resin as a main component, and an external additive such as melamine, large silica, and small silica is added to the binder resin surfaces as appropriate in order to adjust a charge characteristic thereof. Meanwhile, the toner is prepared as finely pulverized toner having an average grain size of 5.7 μm.

(A-1-3) Transfer Belt

Figure 3:
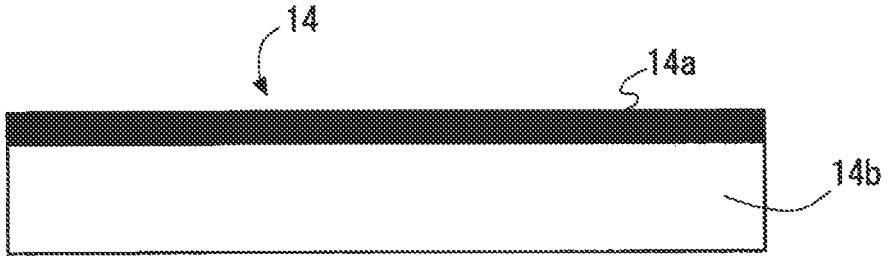
FIG. 3 is a cross-sectional view illustrating a schematic cross section of a transfer belt according to the embodiment.

FIG. 3 is a cross-sectional view illustrating a schematic cross section of transfer belt 14 of this embodiment.

As shown in FIG. 3, transfer belt 14 is formed from two layers: surface layer 14*a* which forms a toner image holding surface and comes into contact with cleaning blade 18; and base layer 14*b* which is covered with surface layer 14*a*.

In general, a film thickness of surface layer 14*a* is desired to be a thin film so that surface layer 14*a* can follow elastic deformation of base layer 14*b*. To be more precise, the film thickness of surface layer 14*a* is set preferably in a range from 50 nm to 10000 nm, or more preferably in a range from 100 nm to 1500 nm.

Base layer 14*b* desirably has a buckling strength of 20 N or above from the viewpoint of durability at an end of transfer belt 14 against a breakage and the like. In this embodiment, a base material having a thickness of 140 μm is used as base layer 14*b*.

[Method of Molding Transfer Belt 14]

Next, a method of molding transfer belt 14 is described.

First, base layer 14*b* made of one or more resin layers is formed, and then surface layer 14*a* is formed on base layer 14*b*. A resin containing a conducting agent is continuously extruded by inflation from a circular nozzle adjusted such that base layer 14*b* has a film thickness of 140 μm and a perimeter of 624±1.5 mm. Thus, a resin tube is formed.

The tube formed by the inflation is cooled by air and then taken up on a roller. The tube is cut into a predetermined width and is attached to the outside of a cylindrical die and is then subjected to a heat treatment. Thus, base member 14*b* of the belt is formed by removing a crease that occurs in the course of taking up the tube. The method of molding base layer 14*b* is not limited to the inflation molding, and base layer 14*b* may also be molded, for example, by extrusion molding, injection molding, centrifugal molding, dip molding, and the like.

Meanwhile, the resin to form base layer 14*b* is not limited to a particular resin. It is preferable from the viewpoints of durability as well as mechanical characteristics that the material of base layer 14*b* exhibit a constant deformation by tension when the belt is driven. In addition, base member 14*b* is desirably made of a material invulnerable to damages such as wears, folds, and cracks on its end portions caused by being repeatedly subjected to sliding on a meandering prevention unit. For example, base layer 14*b* may be made of any one resin out of polyvinylidene fluoride (PVDF), polyamide (PA), polybutyrene terephthalate (PBT), polycarbonate (PC), acrylonitrile-butadiene-styrene (ABS), acrylonitrile-ethylene propylene-styrene, polyacrylonitrile, polyvinyl fluoride, poly (ethylene-propylene hexafluoride), polyethylene trifluoride, polyamide-imide, and polyimide, or a mixture of any of these resins. In this embodiment, polyvinylidene fluoride (PVDF) is used as the resin to form base layer 14*b*.

In the meantime, an appropriate amount of an ionic conducting agent is blended with base layer 14*b* or both of base layer 14*b* and surface layer 14*a* in order to develop conductivity. Examples of the ionic conducting agent include: alkali metal salt such as lithium perchlorate, sodium perchlorate, lithium trifluoromethanesulfonate, lithium tetrafluoroborate, potassium thiocyanate, and lithium thiocyanate; alkali-earth metal salt; quaternary ammonium salt; and the like.

Note that the method of imparting the conductivity to transfer belt 14 is not limited to the ionic conduction. For instance, a method of adding and dispersing carbon black is applicable. Examples of the carbon black include furnace black, channel black, Ketjen black, acetylene black, and the like. Any of these types of carbon black may be used alone or in combination. The types of carbon black to be used are appropriately selected on the basis of intended conductivity. In particular, the channel black or the furnace black is preferably used. Depending on the application, it is preferable to use the carbon black subjected to an oxidation processing or grafting in order to prevent oxidation degradation, or the carbon black with improved dispersibility to a solvent. The content of the carbon black is appropriately determined on the basis of the types of the added carbon black and the purpose thereof. Transfer belt 14 used in this embodiment contains the carbon black in a range from about 30% to 40% by weight with respect to the belt component resin in light of the required mechanical strength and the like.

Volume resistivity ρv of transfer belt 14 thus molded is set preferably in a range from $1\times10^{6}$ Ω·cm to $1\times10^{14}$ Ω·cm inclusive, or more preferably in a range from $1\times10^{9}$ Ω·cm to $1\times10^{13}$ Ω·cm inclusive.

Here, a large amount of the conducting agent has to be added in order to obtain a low-resistance body having the volume resistivity ρv below $1\times10^{6}$ Ω·cm. For this reason, the conducting agent is prone to bleeding to the surface of transfer belt 14 when at a high temperature and high humidity, and is therefore likely to taint a component that is in contact with transfer belt 14, or photoconductor drum 11 in particular. On the other hand, when the volume resistivity ρv is greater than $1\times10^{14}$ Ω·cm, transfer belt 14 becomes a high-resistance body in the case of an increase in resistance under a low-temperature and low-humidity environment or in the case of the occurrence of an increase in resistance with time. Such an increase in resistance is apt to cause a transfer defect. For this reason, it is not preferable to set the volume resistivity ρv below $1\times10^{6}$ Ω·cm or above $1\times10^{14}$ Ω·cm.

Next, base layer 14*b* is molded and temporarily cut into the predetermined width as described above, and is set on an outer peripheral surface of a die. Surface layer 14*a* is formed by spray coating, roller coating, or dip coating, for example. The film thickness of surface layer 14*a* is adjusted on the basis of the concentration or a coating amount of the material to be coated.

Moreover, after surface layer 14*a* is coated on base layer 14*b*, surface layer 14*a* is hardened by UV irradiation or heating. Thereafter, transfer belt 14 provided with surface layer 14*a* is cut into a width of 228.5±0.5 mm.

As the material to form surface layer 14*a*, it is preferable to use polyacrylic, polyacryl urethane, polyester urethane, polyether urethane, polyamide, polycarbonate, polyethylene terephthalate, polyarylate, a fluorine compound, a styrene compound, a naphthalene compound, and the like. In this embodiment, polyacrylic is used as surface layer 14*a*.

Furthermore, an appropriate amount of a fluorine-based or silicone-based water repellent agent is added to a raw material solution for surface layer 14*a*, thus forming transfer belt 14 with an improved surface slippage so as to achieve a static friction coefficient in a range from 0.1 to 1.0 inclusive, and a critical surface tension γc equal to or below 25, and preferably equal to or below 15.

The critical surface tension is found in accordance with the Zisman method by measuring contact angles. The contact angles relative to the surface of transfer belt 14 are measured in an environment at 25° C. and 50% RH with a contact angle meter (Contact Angle Meter CA-X type, manufactured by Kyowa Interface Science Co., Ltd.) while using three types of liquids of n-dodecane (25.0 mN/m), diiodomethane (50.8 mN/m), and pure water (72.8 mN/m).

When a static friction coefficient μs on the surface of transfer belt 14 is too small, cleaning blade 18 does not work sufficiently and residual toner is cleaned insufficiently. On the other hand, when the static friction coefficient μs on the surface of transfer belt 14 is too large, the friction with cleaning blade 18 is increased. The increased friction may cause abnormal noise at a contact portion between transfer belt 14 and cleaning blade 18 or may cause a turn-up of cleaning blade 18. Meanwhile, adhesion between transfer belt 14 and an attached substance becomes smaller as the critical surface tension γc is smaller, so that cleaning blade 18 can scrape off the attached substances more easily. However, if an excessive amount of the additive is added to surface layer 14*a*, a phenomenon of bleeding of the additive to the surface of transfer belt 14 is apt to occur over time, and the bled additive may adhere to photoconductor drum 11 and may cause an imaging defect. Accordingly, the amount of addition of the water repellent agent has to be determined carefully.

(A-2) Operation of Embodiment

A result of an abrasion resistance test of the outer peripheral surface of transfer belt 14 of this embodiment, a result of the evaluation of a cleaning performance thereof, and a result of a change in specularity thereof are illustrated and described below.

[Evaluation of Surface Characteristics of Transfer Belt 14]

As surface characteristics of transfer belt 14, surface hardness and reversibility against pressure deformation are evaluated in particular.

The hardness of the surface of transfer belt 14 is evaluated by using Vickers hardness (HV) as an index. Meanwhile, reversibility against the pressure deformation of transfer belt 14 is evaluated by using a low-load creep (C_IT_L) as an index.

Here, the low-load creep is an index which indicates reversibility as to how much recessed deformation caused by pressing a hardness measurement indenter by a predetermined amount recovers after the indenter is unloaded. Here, the deformation is deemed to be more reversible when the value of the low-load creep is closer to "0." In other words, when C_IT_L=0, the recessed deformation formed by pressing completely recovers to the original state.

The hardness of the surface of surface layer 14*a* of transfer belt 14, and the low-load creep thereof, are measured by using Nano Indenter G200 manufactured by Toyo Corporation.

Measurement conditions are now described. A nanoindentation method in compliance with ISO 14577-1 is used as a measurement method. A measurement environment is set in a range of from 25° C. to 26° C. (an environment inside a measurement machine, and an actually measured value), and the measurement is carried out by using a Berkovich (TB13289) as a measurement indenter. A maximum load is set to 1 mN, maximum load holding time is set to 10 s, time to reach the maximum load is set to 30 s, and a pressing speed is set to 0.33 mN/s. An unload rate from the maximum load (percent to unload) is set to 0.9%, and the thermal drift is set equal to or below 1 nm/s.

To be more precise, a sample for hardness measurement is prepared by forming surface layer 14*a* with a thickness of 10 μm formed on a PVDF film, and the hardness of the material is measured by using the sample. Specifically, the surface hardness and the low-load creep of surface layer 14*a* are measured in compliance with ISO 14577-1, and the Vickers hardness (HV) and the low-load creep (C_IT_L) are measured while pressing the indenter into the sample at such a rate to reach the maximum load of 1.0 mN after 30 seconds.

[Amount of Change in Specularity]

Specularity of transfer belt 14 is measured before and after a printing durability test.

The specularity of transfer belt 14 can be adjusted by appropriately changing the film thickness of surface layer 14*a* while changing the coating amount. In other words, when the film thickness of surface layer 14*a* is smaller, surface layer 14*a* is more likely to be affected by surface roughness of base layer 14*b*, and the specularity of the outermost surface is reduced accordingly. On the other hand, when the film thickness of surface layer 14*a* is greater, surface layer 14*a* is less likely to be affected by the surface roughness of base layer 14*b*, and the specularity of the outermost surface can be increased accordingly.

The surface of transfer belt 14 is smoother when its specularity is larger. In order to avoid slip through of the toner, the surface specularity of transfer belt 14 in contact with cleaning blade 18 is preferably set as large as possible. The specularity needs to be equal to or above 50, and is preferably equal to or above 60, because the specularity is reduced by the occurrence of wears and scratches on the surface with the passage of printing time and it is preferable to maintain the smooth surface with the specularity equal to or above 50 even at the end of the product life thereof. In this embodiment, transfer belt 14 is used with the specularity in a range of from 70 to 80.

The specularity is measured in accordance with an imaging pattern evaluation method. An object for measuring the specularity is provided on the surface of transfer belt 14. Then, the object on the surface of transfer belt 14 is imaged in accordance with the imaging pattern evaluation method, and qualities of a reflection image and image clarity of the object are quantitatively measured. Thus, the surface characteristics of transfer belt 14 can be evaluated. The imaging pattern evaluation method has a wide measurement range of 200 $mm^2$, and is capable of evaluating the surface characteristics of transfer belt 14 properly. Unlike a probe-type roughness measurement machine, a specularity measurement machine used in the imaging pattern evaluation method is not designed to measure the surface by tracing the surface with a peaked probe. In other words, the specularity measurement machine can perform a non-destructive evaluation. Accordingly, it is possible to perform the evaluation without damaging the surface of transfer belt 14, and to perform the measurement within a range of several millimeters. For this reason, the specularity measurement machine can evaluate a wider range as compared to the probe-type roughness measurement machine and is therefore advantageous as the method of evaluating the surface characteristics of transfer belt 14. The surface specularity of transfer belt 14 is measured by use of a mirror surface machine (SPOT AHS 100-S) manufactured by ARC HARIMA Co., Ltd (see Japanese Patent Application Publication No. 2007-225969, for example).

[Evaluation of Abrasion Resistance of Surface of Transfer Belt 14]

Abrasion resistance of the surface of the belt is evaluated by conducting an abrasion test of the outer peripheral surface of the belt by using a Taber abrasion tester, namely, Rotary Abrasion Tester TS manufactured by Toyo Seiki Seisaku-sho Ltd.

To be more precise, the abrasion test is performed under conditions of; a load at 500 g, a speed of 60 rpm (revolutions per minute), and rotations of 200 revolutions using a wear ring prepared by attaching wrapping paper (#4000/$Al_2O_3$ abrasive) made of Sumitomo 3M Limited to a wear ring CS0. Here, the film thicknesses are measured at six positions on a portion of transfer belt 14 where the wear ring slides on, and an average value thereof is defined as an abrasion amount. In other words, a larger abrasion amount means that transfer belt 14 wears off easily. On the other hand, a smaller abrasion amount means that is transfer belt 14 does not wear off easily.

[Evaluation of Cleaning Performance (Slip-Through Evaluation)]

Evaluation of the cleaning performance is conducted by using a printer C711dn manufactured by Oki Data Corporation.

Specifically, PPC (plain paper copy) sheets are used as record sheets. As for a testing environment, the printing is performed on 100 thousand pages in a low-temperature and low-humidity environment (LL environment: temperature at 10° C. and humidity at 20%). As for an image used for the printing evaluation, lateral lines in YMCK colors are printed on two sides at 0.5% density per sheet and at a rate of 3 P/J (an operation to consecutively print on three pages and then to pause for 7 seconds). Hence, the change in specularity and the cleaning performance are evaluated with the passage of printing time. Here, the specularity before and after the printing durability test is measured and the change in the surface of transfer belt 14 caused by the printing durability test is evaluated.

The quality of the cleaning performance is evaluated on the basis of the number of printed sheets in which a taint of the toner slipping through (slip through in the form of a thin line) occurs on the back of the printed surface. Here, the cleaning performance is evaluated based on the following criteria. Specifically, "Evaluation value: 1" means no cleaning defects in 100 thousand pages, "Evaluation value: 2" means slip through occurs somewhere in 80 thousandth to 100 thousandth page, "Evaluation value: 3" means slip through occurs somewhere in 60 thousandth to 80 thousandth page, and "Evaluation value: 4" means slip through occurs somewhere below 60 thousandth page. In other words, the "Evaluation value: 1" means the highest evaluation.

[Evaluation Results]

FIG. 6 lists the results of the abrasion resistance tests, results of the cleaning performances, and results of changes in the specularity of transfer belts 14 having different surface hardness characteristics.

In this embodiment, polyacrylic surface layers 14*a* having different hardness characteristics (HV, C_IT_L) are formed by using various monomer materials, which have different abundance ratios between a rigid component containing an aromatic ring or the like and a soft component containing a long-chain alkyl group or the like, for side chains of the polyacrylic materials used in surface layers 14*a*.

To be more precise, polymers of acrylic urethane are used as coating resins of surface layer 14*a*. Here, the Vickers hardness (HV) can be increased by blending a larger amount of the acrylic component (skeleton) being a hard component. The low-load creep (C_IT_L) can be increased by blending a larger amount of an urethane component (skeleton) which is an elastically recoverable component.

In this embodiment, fifteen samples of surface layers 14*a* with different hardness characteristics (HV, C_IT_L) are defined as Example 1 to Example 15 to be described later.

Figure 4:
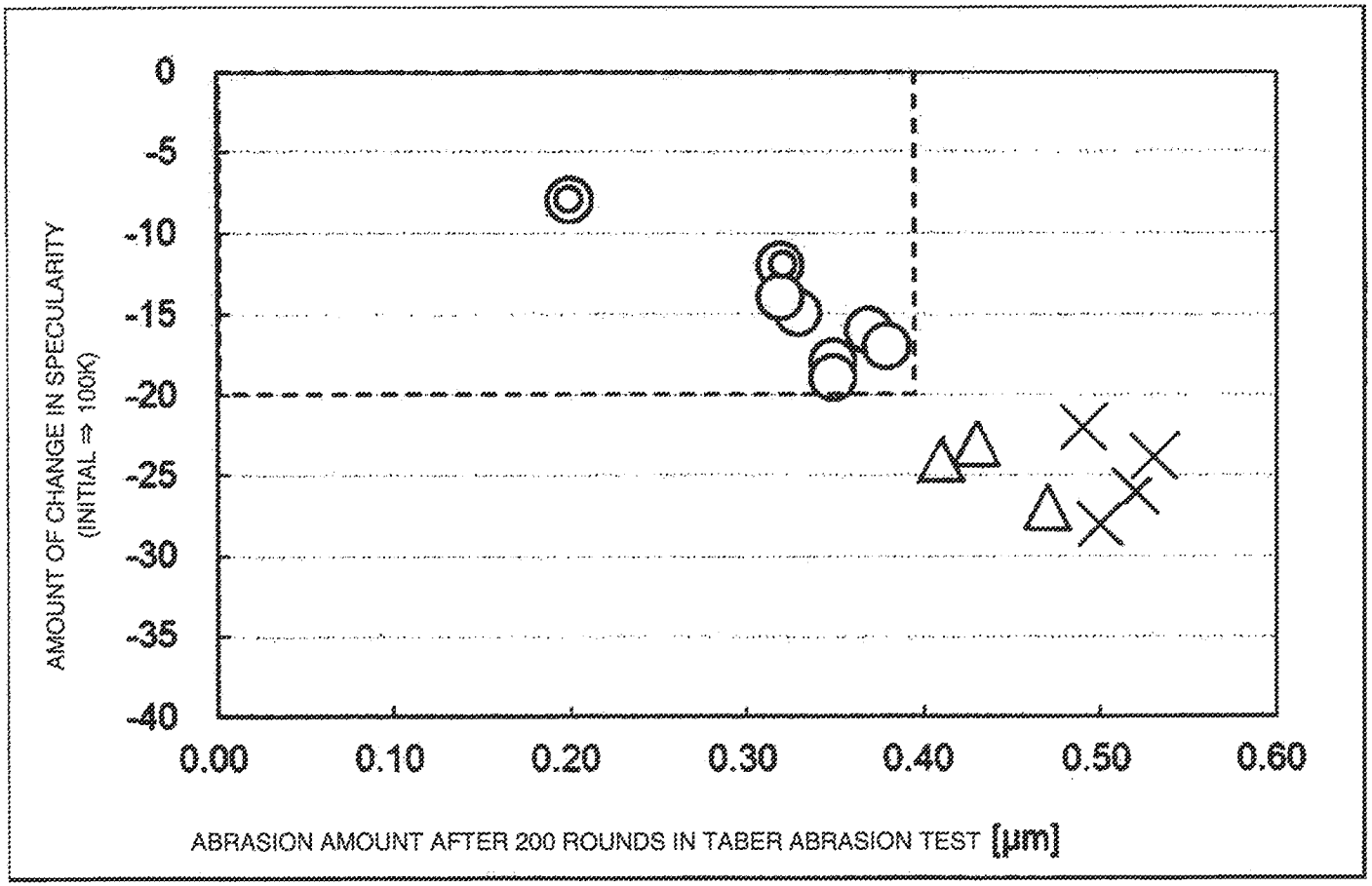
FIG. 4 is a graph illustrating the results of abrasion resistance tests of the outer peripheral surfaces of transfer belts according to the embodiment.

FIG. 4 is a graph illustrating the results of abrasion resistance tests of the outer peripheral surfaces of transfer belts 14. In FIG. 4, the vertical axis indicates the low-load creep (C_IT_L [%]) and the horizontal axis indicates the Vickers hardness (HV [N/mm$^2$]).

Figure 5:
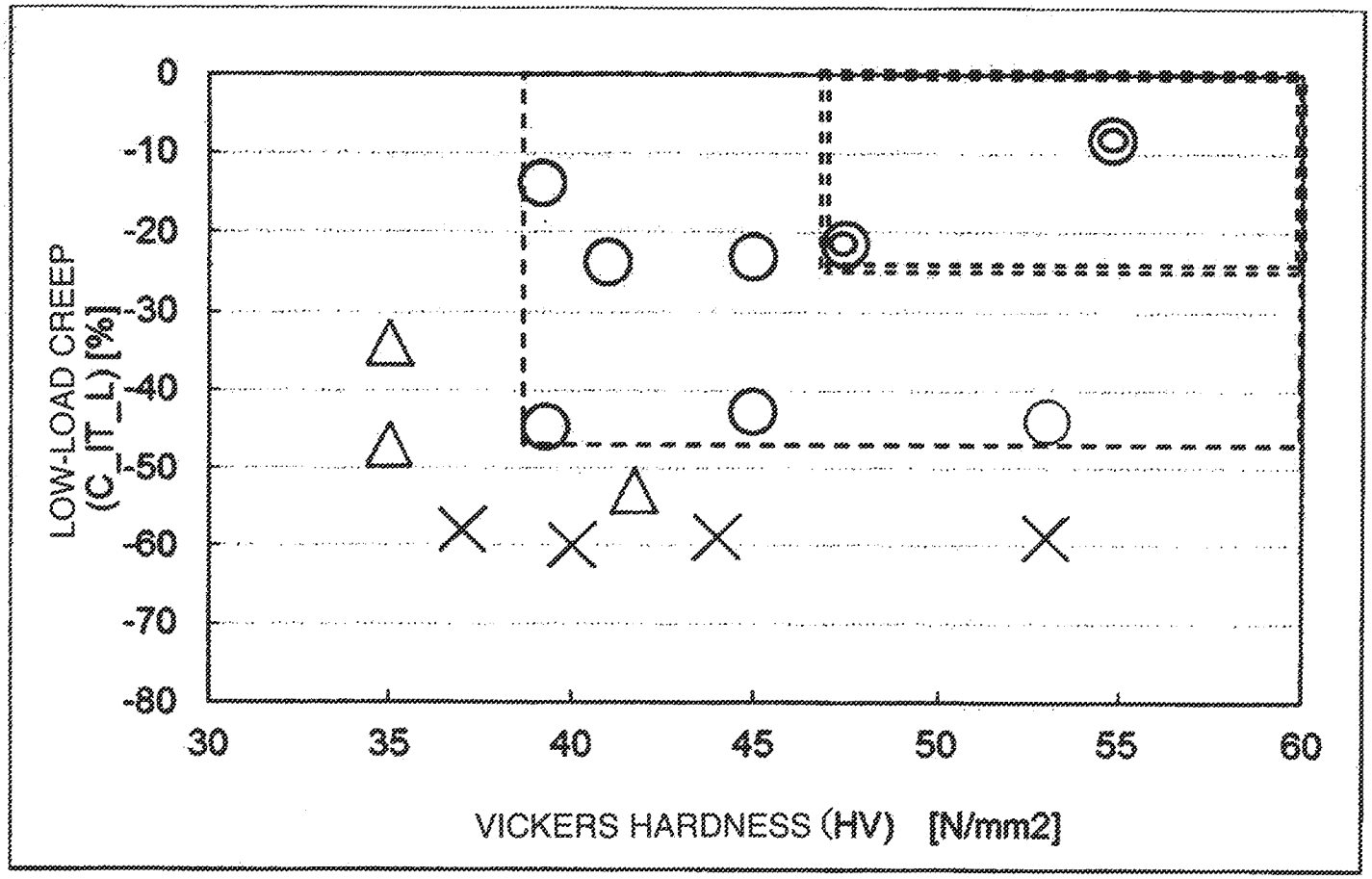
FIG. 5 is a graph illustrating the evaluation results of cleaning performances of the transfer belts according to the embodiment.

FIG. 5 is a graph illustrating the evaluation results of the cleaning performances of transfer belts 14. In FIG. 5, the vertical axis indicates the amount of change in specularity and the horizontal axis indicates the abrasion amount ([μm]) after 200 rounds of the Taber abrasion test.

From the results in FIG. 6 and FIG. 4, it is apparent that the cleaning performance is favorable when the Vickers hardness (HV) of the outer peripheral surface of transfer belt 14 is in a range from 39 [N/mm$^2$] to 60 [N/mm$^2$] inclusive and the low-load creep (C_IT_L) of the outer peripheral surface of transfer belt 14 is in a range of from −45 [%] to 0 [%] inclusive.

Meanwhile, in light of the hardness of the surface of transfer belt 14, from the results in FIG. 6 and FIG. 4, it is apparent that the cleaning performance is favorable when the Vickers hardness (HV) of the outer peripheral surface of transfer belt 14 is in a range of from 39 [N/mm$^2$] to 60 [N/mm$^2$] inclusive and the low-load creep (C_IT_L) of the outer peripheral surface of transfer belt 14 is in a range of from −24 [%] to 0 [%] inclusive.

Moreover, in light of the reversibility of the deformation on the surface of transfer belt 14, from the results in FIG. 6 and FIG. 4, it is apparent that the cleaning performance is favorable when the Vickers hardness (HV) of the outer peripheral surface of transfer belt 14 is in a range of from 48 [N/mm$^2$] to 60 [N/mm$^2$] inclusive and the low-load creep (C_IT_L) of the outer peripheral surface of transfer belt 14 is in a range of from −44 [%] to 0 [%] inclusive.

Furthermore, from the results in FIG. 6 and FIG. 4, it is apparent that the favorable cleaning performance can be maintained for a long period when the Vickers hardness (HV) of the outer peripheral surface of transfer belt 14 is in a range of from 48 [N/mm$^2$] to 60 [N/mm$^2$] inclusive and the low-load creep (C_IT_L) of the outer peripheral surface of transfer belt 14 is in a range of from −22 [%] to 0 [%] inclusive.

Here, in this embodiment, an upper limit of the Vickers hardness (HV) is determined to be equal to or below 60 [N/mm$^2$]. This is due to the reason that, if the Vickers hardness (HV) exceeds 60 [N/mm$^2$], the surface of transfer belt 14 becomes too hard and transfer belt 14 may cause cracks during rotation due to bending fatigue, and may eventually cause a breakage on the surface of transfer belt 14 or destruction of transfer belt 14. It is also possible to reduce the film thickness of surface layer 14*a* of transfer belt 14 below 100 nm in order to improve the crack resistance. However, when transfer belt 14 is provided with the hard and low-load-creep surface characteristics, the wear of transfer belt 14 gradually progresses along with printing whereby part of the surface of transfer belt 14 may be lost at its product life. In the meantime, if the film thickness of surface layer 14*a* of transfer belt 14 is set too small, the coverage of the roughness of base layer 14*b* may be insufficient. Hence, it may be difficult to reduce the surface roughness of surface layer 14*a* after the coating and the cleaning performance may also be deteriorated accordingly. Due to these reasons, the upper limit of the Vickers hardness (HV) is determined to be equal to or below 60 [N/mm$^2$] in this embodiment.

From the results in FIG. 6 and FIG. 5, it is apparent that the ease of abrasion of the surface of transfer belt 14 and the amount of change in specularity of transfer belt 14 with the passage of printing time have a negative correlation. In other words, as for the specularity of the surface of transfer belt 14 with passage of printing time, an amount of reduction in specularity becomes greater as the abrasion of the surface of transfer belt 14 is greater.

That is to say, when the Vickers hardness (HV) of the outer peripheral surface of transfer belt 14 is in the range of from 39 [N/mm$^2$] to 60 [N/mm$^2$] inclusive, and the low-load creep (C_IT_L) of the outer peripheral surface of transfer belt 14 is in the range of from −45 [%] to 0 [%] inclusive, the abrasion amount of the surface of transfer belt 14 is small at the Taber abrasion test. Specifically, the abrasion amount is equal to or below 0.38 μm and the amount of reduction in specularity of the surface of transfer belt 14 is equal to or below 20. Thus, the degree of the surface change after the printing is small and the surface can maintain its smoothness. Accordingly, it is apparent that the cleaning performance is maintained for a long period and no slip through occurs after printing 80 thousand pages.

More asperities on the surface of transfer belt 14 are likely to trigger adhesion of a substance that comes into contact. In this case, a scraping failure by cleaning blade 18 is likely to occur more frequently.

The reason can be described as follows. In general, as the printing progresses, foreign substances derived from the toner or the record materials that are mainly derived from paper are gradually attached to and deposited on transfer belt 14. Once such an attached substance sticks onto transfer belt 14, the same materials are likely to attract each other whereby the attachment is likely to be promoted. This phenomenon is attributed to an increase in intermolecular force or an increase in compatibility. In the meantime, the substances derived from the toner or the paper mainly include silica or calcium carbonate. These substances are extremely hard and promote scars and an abrasion of transfer belt 14, which is a contacting component, thereby causing scratches thereon. This phenomenon is promoted when the Vickers hardness (HV) is smaller than 39 [N/mm$^2$] and the low-load creep (C_IT_L) is smaller than −45 [%]. The reason is described below in further detail.

Scratches are apt to occur on the surface of transfer belt 14 if the Vickers hardness (HV) of the surface of transfer belt 14 is smaller than 39 [N/mm$^2$]. This is because as the hardness of the surface of transfer belt 14 is lower, hard silica or calcium carbonate derived from the paper causes more scratches on the surface of transfer belt 14 along with the printing process, and the softness of the surface of transfer belt 14 promotes the growth of the scratches. As a consequence, close contact between cleaning blade 18 and transfer belt 14 is degraded and cleaning defects are apt to occur more frequently. This fact indicates that the mere large specularity is not enough. In the meantime, the substances such as silica and calcium carbonate deposited on portions of cleaning blade 18 are pressed into the surface of transfer belt 14 due to the linear pressure of cleaning blade 18. As a consequence, transfer belt 14 is deformed into a recessed shape and such deformation appears on the surface of transfer belt 14 as a scar extending in the circumferential direction.

In short, if the Vickers hardness (HV) of the surface of transfer belt 14 is smaller than 39 [N/mm$^2$], the cleaning performance is favorable only in an initial state but scratches occur on the surface of transfer belt 14 as the printing process continues. As a consequence, the cleaning performance is degraded together with the deterioration in the specularity.

On the other hand, when the Vickers hardness (HV) of the surface of transfer belt 14 is equal to or above 39 [N/mm$^2$], the hardness of the surface of transfer belt 14 is increased and the scratches are less likely to occur. Thus, the cleaning performance can be maintained.

If the low-load creep of the surface of transfer belt 14 is smaller than −45%, the recessed deformation on transfer belt 14 hardly recovers even after transfer belt 14 passes through cleaning blade 18. Hence, the depth of the recess and the number of scars in transfer belt 14 are increased along with the passage of printing time. Agglomerated substances, such as the aforementioned silica, are constantly deposited on, and attached to, the locally recessed portions that are increased in depth as well as in number. As a consequence, the agglomerate substances induce the slip through. At the same time, the agglomerate substances promote the occurrence of more scratches on the surface of transfer belt 14, which further accelerate the slip through.

On the other hand, when the low-load creep of the surface of transfer belt 14 is equal to or above −45%, the scar deformed into the recessed shape in the surface can easily recover the original shape, and the deposition of the hard agglomerated substances such as silica on the surface of transfer belt 14 can be suppressed. Thus, the slip through of the toner can be suppressed accordingly.

If the Vickers hardness (HV) of the surface of transfer belt 14 is smaller than 39 [N/mm$^2$] and the low-load creep thereof is smaller than −45%, the recessed deformation on the surface and scratches are both accelerated whereby the surface of transfer belt 14 is presumably worn even more significantly. This phenomenon is described below.

As illustrated in FIG. 5, as the abrasion amount of the surface of transfer belt 14 is greater, the amount of reduction in specularity with the passage of printing time grows larger. This fact indicates that the abrasion of the surface of transfer belt 14 by the printing process reduces the specularity thereof, and the belt surface is transformed into a surface with numerous asperities which easily cause the slip through.

When the numerous asperities are formed on the surface due to the abrasion of transfer belt 14 with the passage of printing time, a wax or the external additive in the vicinity of a printed surface (a first surface) of the record medium is likely to be scraped off due to micro slip of transfer belt 14 relative to the printed surface. The wax or the external additive thus scraped off causes an attachment of the attached substances onto the surface of transfer belt 14. The wax or the external additive thus attached is more likely to remain at an edge portion of cleaning blade 18. As a consequence, the attached substances slip through cleaning blade 18 and cause cleaning defects. For this reason, it is necessary to maintain the surface of transfer belt 14 as a smooth surface before the printing.

Furthermore, as the substances remaining on transfer belt 14 are increased, the adhesion or affinity between cleaning blade 18 and the substances remaining on the surface of transfer belt 14 is increased, thereby causing a phenomenon of an increase in frictional force. The increase in frictional force increases a shear stress between the surface of transfer belt 14 and cleaning blade 18. As a consequence, a critical phenomenon such as a local edge crack or turn-up of cleaning blade 18 may occur.

There is also proposed a method of setting the linear pressure of cleaning blade 18 higher and thereby to reduce cleaning defects. However, this method considerably increases a burden on cleaning blade 18 and may cause a breakage of the edge of cleaning blade 18 or promote a turn-up phenomenon of cleaning blade 18. In addition, the increase in linear pressure of cleaning blade 18 may also accelerate the occurrence of scratches on the surface of transfer belt 14, and is therefore not preferred.

On the other hand, by setting the Vickers hardness (HV) of transfer belt 14 in the range of from 39 [N/mm$^2$] to 60 [N/mm$^2$] inclusive and the low-load creep (C_IT_L) of the outer peripheral surface of transfer belt 14 in the range of from −45 [%] to 0 [%] inclusive, it is possible to suppress the scratches attributed to the attached substances and graze, abrasion of the surface, and deformation of the surface.

(A-3) Effects of the Embodiment

As described above, according to this embodiment, the transfer belt has surface characteristics such that: the Vickers hardness (HV) of the outer peripheral surface of the transfer belt is in the range of from 39 [N/mm$^2$] to 60 [N/mm$^2$] inclusive; and the low-load creep (C_IT_L) of the outer peripheral surface of the transfer belt is in the range of from −45 [%] to 0 [%] inclusive. Thus, it is possible to suppress the scratches attributed to the graze as well as the attached hard substances such as the external additive of the toner and paper powder, abrasion of the surface, and deformation of the surface. Thus, the smooth surface can be maintained. For this reason, it is possible to efficiently clean the attached substances on the belt by using the cleaning blade. As a consequence, the cleaning performance of the transfer belt can be maintained for a long period.

(B) Other Embodiments

Although various modified embodiments are stated in the above-described embodiment, the invention is also applicable to the following modified embodiments as well.

The above embodiment describes an example of applying the invention to an electrophotographic color printer. However, the invention is broadly applicable to various transfer belts of belt mechanisms, transfer belt units including any of the transfer belts, and image formation apparatus including any of the transfer belt units.

The above embodiment describes the example of applying the invention to the transfer belt adopting a direct transfer method configured to provide the transfer roller at the position opposed to the photoconductor drum and to transfer a toner image formed on the photoconductor drum onto the medium by applying a predetermined voltage to the transfer roller.

Figure 7B:
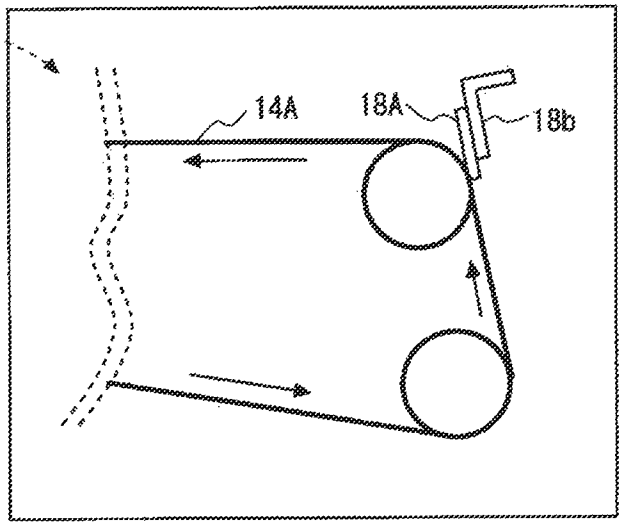
FIGS. 7A and 7B are configuration diagrams illustrating an intermediate transfer belt according to a modified embodiment.
Figure 7A:
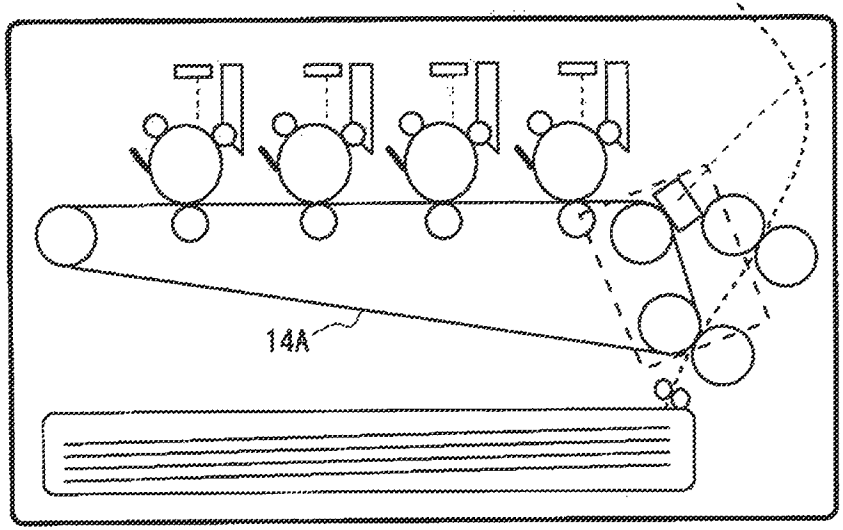

However, the transfer belt of the invention is not limited only to the transfer belt adopting the direct transfer method but is also applicable to an intermediate transfer belt adopting an intermediate transfer method as illustrated in FIGS. 7A and 7B as an example, or to a fixation belt.

FIG. 7A is a view illustrating an internal configuration of image formation apparatus 1A adopting the intermediate transfer method. FIG. 7B is an enlarged view of a configuration in the vicinity of cleaning blade 18A of intermediate transfer belt 14A in FIG. 7A. The intermediate transfer method is a method configured to transfer a toner image formed on a photoconductor drum to an intermediate belt, and then to transfer the toner image further to a medium. The invention is also applicable to intermediate transfer belt 14A illustrated as the example in FIG. 7A and FIG. 7B.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. A transfer belt used in an image formation apparatus, wherein the transfer belt is provided with surface characteristics that Vickers hardness of an outer peripheral surface of the transfer belt is equal to or above 39 N/mm$^2$ and equal to or below 60 N/mm$^2$ and low-load creep of the outer peripheral surface is equal to or above −45% and equal or to below 0%.

2. The transfer belt according to claim 1, wherein the transfer belt is provided with the surface characteristics that the Vickers hardness of the outer peripheral surface is equal to or above 39 N/mm$^2$ and equal to or below 60 N/mm$^2$ and the low-load creep of the outer peripheral surface is equal to or above −24% and equal or to below 0%.

3. The transfer belt according to claim 1, wherein the transfer belt is provided with the surface characteristics that the Vickers hardness of the outer peripheral surface is equal to or above 48 N/mm$^2$ and equal to or below 60 N/mm$^2$ and the low-load creep of the outer peripheral surface is equal to or above −44% and equal to or below 0%.

4. The transfer belt according to claim 1, wherein the transfer belt is provided with the surface characteristics that the Vickers hardness of the outer peripheral surface is equal to or above 48 N/mm$^2$ and equal to or below 60 N/mm$^2$ and the low-load creep of the outer peripheral surface is equal to or above −22% and equal or to below 0%.

5. The transfer belt according to claim 1, wherein the transfer belt comprises:

a surface layer constituting the outer peripheral surface; and a base layer made of one or more resin layers and covered with the surface layer.

6. The transfer belt according to claim 1, wherein the transfer belt comprises a surface layer constituting the outer peripheral surface in a film thickness of equal to or above 100 nm and equal to or below 1500 nm.

7. A transfer belt unit comprising: the transfer belt according to claim 1; and a drive roller configured to convey the transfer belt.

8. An image formation apparatus comprising: an image carrier on which a developer image is to be formed; and the transfer belt unit according to claim 7 and configured to transfer the developer image onto a medium being conveyed by and on the transfer belt.

* * * * *